United States Patent [19]

Somodi

[11] Patent Number: 4,479,441

[45] Date of Patent: Oct. 30, 1984

[54] STEPPED HEARTH INCINERATOR WITH POSITIVE CLEAN-OUT OF AIR FEED-TUBES

[75] Inventor: John S. Somodi, Olmsted Falls, Ohio

[73] Assignee: Enercon Systems, Incorporated, Cleveland, Ohio

[21] Appl. No.: 588,966

[22] Filed: Mar. 13, 1984

[51] Int. Cl.[3] ..... F23G 5/00

[52] U.S. Cl. ..... 110/257; 110/291; 110/298

[58] Field of Search ..... 110/291, 225, 255, 257, 110/281, 298, 299, 300

[56] References Cited

U.S. PATENT DOCUMENTS 2,007,028 7/1935 Taylor ..... 110/291 X
3,812,794 5/1974 Taylor ..... 110/257 X
3,863,578 2/1975 Kato et al. ..... 110/257
4,172,425 10/1979 Sheridan ..... 110/291 X

*Primary Examiner*—Edward G. Favors
*Attorney, Agent, or Firm*—Alfred D. Lobo

[57] ABSTRACT

An inclined hearth incinerator for the incineration of municipal, and industrial/commercial solid waste optionally in conjunction with sludge, with a controlled amount of combustion air allows the even distribution of underfire air to an upper hearth of plural stepped hearths in the floor of the incinerator. A clean-out assembly includes a piston which automatically cleans out feed-tubes for combustion air. The feed-tubes are protected by being embedded in the hearth, or being disposed beneath the hearth. The piston and a ram on the hearth may be interconnected for reciprocation by an actuating means so as to provide synchronous to-and-fro movement of the piston and ram.

18 Claims, 3 Drawing Figures

STEPPED HEARTH INCINERATOR WITH POSITIVE CLEAN-OUT OF AIR FEED-TUBES

BACKGROUND OF THE INVENTION

This invention is related to waste incinerators such as are used in numerous municipalities, and in industrial/-commercial operations. More particularly it relates to an inclined hearth, and particularly to a multiple stepped hearth or stepped floor incinerator into which waste to be incinerated is loaded at one end, and incinerated waste residue including ashes is removed from the other. By "waste" I refer to municipal solid waste, and industrial/commercial solid waste, optionally mixed with sludge. Municipal solid waste includes garbage and refuse, scrap paper, glass scrap and metals of the common types, many of which may melt, like glass, at incineration temperatures generated in the incinerator. Industrial/commercial solid waste includes cardboard and other paper products, packing materials of all types, wood, plastic and glass scrap, and the like. Sludge is typically semi-solid waste such as is generated in paint plants, paper mills and the like, or in municipal water treatment facilities, and if sludge is to be incinerated it will generally be mixed with the foregoing solid wastes. All the foregoing wastes including sludge are referred to hereafter as "waste".

Incinerators of this general type are disclosed in U.S. Pat. Nos. 4,172,425, and 3,812,794 inter alia. They are "mass burning", that is, the heterogeneous waste is burned essentially as received from the typical municipal garbage truck, rubbish disposal truck, or industrial plant. The waste may be unprocessed, or processed before it is incinerated. Incinerating this hetrogeneous waste successfully has been the goal of numerous incinerator designs, some of which are referenced in the '425 patent. These designs include a variety of grate configurations designed to move, advance, shuffle, tumble or otherwise mix and agitate the burning waste so as to provide better incineration due to better distribution of primary air.

All modern incinerators have systems for the distribution of combustion air to the waste. Commonly this distribution is in the form of overfire combustion air (above waste bed) and underfire combustion air (below waste bed), although some designs preclude the use of overfire combustion air.

Underfire combustion air has typically been supplied through a "grate" system comprising cast iron or alloy metal shapes through which the air passes, similar to the grates utilized in a coal-fired boiler. This air cools the grates in addition to providing oxygen for combustion.

Other designs utilize refractory hearths in place of the grates with air distribution through holes or through metallic pipes with holes in them.

Both underfire combustion air designs are subject to plugging of the air passages and holes with molten materials such as glass, metal, plastics and mixtures of these with ash, metal, etc. This pluggage reduces the flow of air resulting in lower combustion rates and poor "burn-out" of the combustibles. In addition, once the molten materials have cooled, a labor-intensive operation is required to clean out the air passages or holes. Flammable molten materials may flow through the passages and burn below the grates causing thermal damage.

This invention is primarily directed to stepped hearth, controlled combustion air incinerators of the general type disclosed in the '425 patent and the references cited therein. This invention is not especially well suited for adaptation in "grate" incinerators.

A stepped hearth incinerator conventionally comprises an elongated housing defining a combustion chamber the floor of which comprises stepped hearths on which combustion of the waste occurs. Means are provided for loading the waste through one end wall of the combustion chamber onto the loading hearth which is uppermost in the floor of stepped hearths in the combustion chamber. Further, ram means are provided for advancing solid waste over at least the first (uppermost) hearth to provide controlled advancement of the waste during the initial stage of its incineration, and to avoid the sudden and sporadic movement of large piles of waste, which movement would occur if no ram means were used.

By "ram means" I refer to any member which is longitudinally reciprocable against waste within a zone in the incinerator, and which member has the effect of advancing the waste through that zone. The constructional details of the ram means are not critical, are well known to those skilled in the art, and are disclosed in the '425 patent, inter alia, along with various other conventional structural details and factual statements with regard to the general considerations pertinent to the operation of the incinerator. Such common facts and analogous structural details are incorporated by reference thereto as if fully set forth herein, so as not to burden this specification unnecessarily.

In particular, air injection nozzles used in the '425 invention are carried by the ram; and these nozzles which inject air into the burning waste are susceptible to pluggage by molten debris and ash. The problems endemic to the operation of prior art systems provided the impetus to dissociate the air injection means and ram means; to eschew the use of perforated nozzles; to protect air feed-tubes from the high temperatures generated during combustion; to provide a positive clean-out for the air feed-tubes, to keep their ends in the burning waste open; and, to provide means for effectively cleaning passages in hearths and sidewalls.

The significance of my invention will be appreciated when it is realized that in general, incinerator modules burning municipal solid waste require more maintenance than those burning industrial refuse. In addition, more operational interruptions must be anticipated when burning municipal waste, because of the jams caused by large metal objects in the waste and the greater frequency of routine maintenance. Thus minimizing labor is of great importance. In particular, the module of the '425 type, because of its more extensive control system, required more maintenance than expected on the automatic control, hydraulic and residual removal system (see "Small Modular Incinerator Systems with Heat Recovery: A Technical, Environmental and Economical Evaluation" by Richard Frounfelker, U.S. Environmental Protection Agency 1979).

SUMMARY OF THE INVENTION

It is a general object of this invention to provide an underfire air distribution system for an inclined hearth waste incinerator into the combustion chamber of which, controlled combustion air is to be uniformly delivered in a predetermined pattern and amount to the waste.

More specifically, in addition to the conventional arrangement of individual hearths arranged in descending order to form the inclined bed of a stepped-hearth incinerator, it has been found that each upper portion of a stepped hearth may be used to protect the metal conduits of the air distribution system from the high temperatures of the combustion zone, and also permit a unique configuration of air feed-tubes which allow them to be positively cleaned, at preselected intervals, by a clean-out means, which, if desired, may be drivingly connected to the ram, if one is used.

It is a specific object of this invention to provide an underfire air distribution system comprising a plurality of air feed-tubes embedded within or covered by a refractory or insulating hearth material, through a vertical portion of which underfire air is evenly distributed to the waste being burned, except of course, at those times of very brief duration during which the air feed-tubes are being cleaned positively. Cleaning is effected by a piston slidably disposed within each air feed-tube and reciprocably actuated for to-and-fro longitudinal movement by an actuating means which provides a stroke of sufficient length to allow the piston to protrude from the mouths of its air feed-tube and push into the waste.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF A PREFERRED EMBODIMENT

Figure 1:
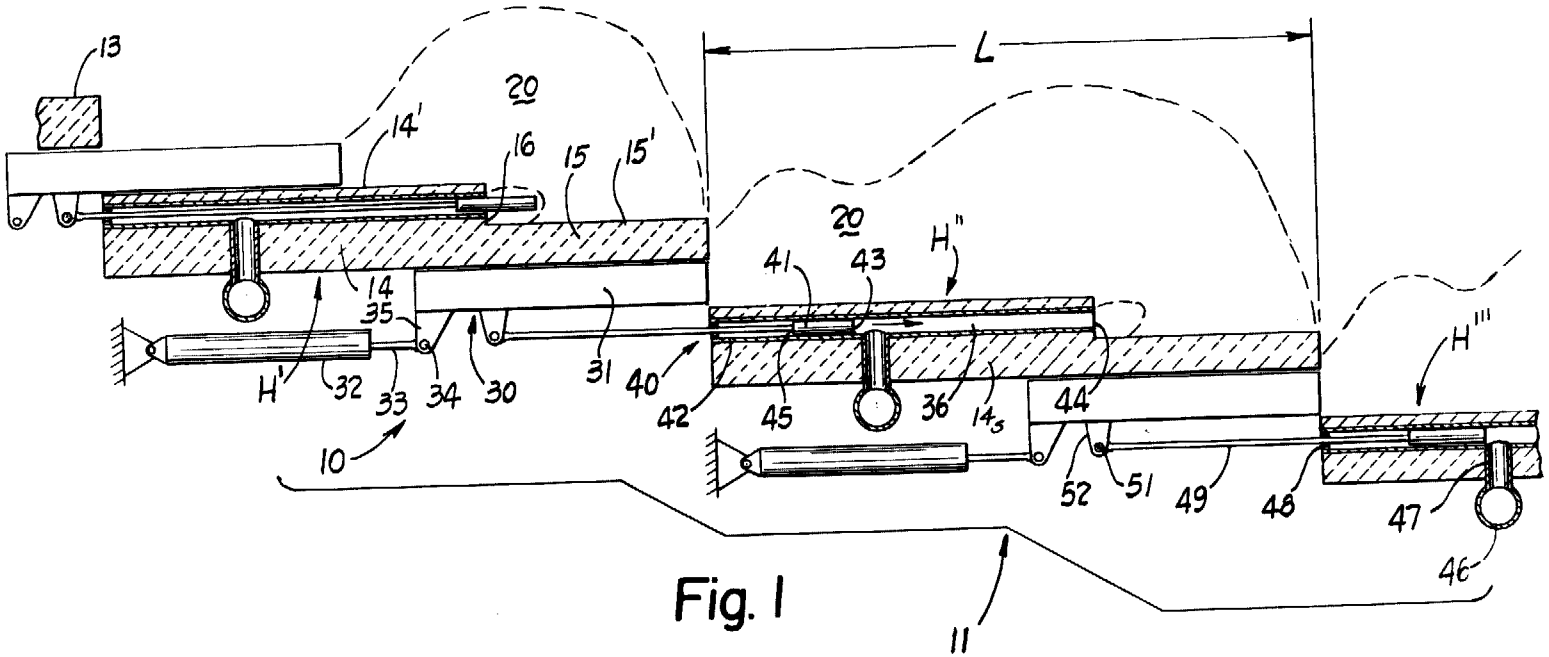
FIG. 1 is an elevational cross-sectional view of a portion of a stepped hearth incinerator, diagrammatically illustrating the invention.

Referring now to the drawings, FIG. 1 is a side elevational cross-sectional view which diagrammatically illustrates the relevant portions of an incinerator indicated generally by reference numeral 10, having a floor 11 comprising plural stepped hearths H', H'', H''' et seq., descendingly arranged. The stepped hearths support waste 20 to be incinerated in a generally elongated combustion chamber defined by a housing comprising a steel shell with side walls 12 (shown in FIGS. 2 and 3), roof and floor portions, all interiorly successively lined with mineral wool block insulation and refractory material; and, the chamber may be provided with pressure burners to commence combustion, all of which features are known in the art, are disclosed in greater detail in the '425 patent, inter alia, are unrelated to the thrust of my invention, and are therefore not shown.

Each stepped-hearth H', H'', H''' et seq is similarly constructed of refractory material and supported within the shell on structural steel. H' is shown as the first, or uppermost hearth which extends longitudinally into the incinerator's chamber, stepped down from the loading hearth 13 just inside the loading door (not shown) of the incinerator. In the most preferred embodiment, and the best mode illustrated, the hearth H', like the others, has an upper portion 14 having a first top surface 14', and a lower portion 15 having a second to top surface 15', the portions being integral with the hearth H' and separated by a vertical portion 16 of the hearth. As will presently be evident the height of the vertical portion 16 is greater than the diameter of feed-tube 42 through which a combustion-supporting gas, generally predominantly air, is fed. As will also be presently evident, the feed-tube is positioned slightly above the top surface 15' of the lower portion. The height of the vertical portion 16 is preferably in the range from about twice to about 4 times the diameter of the feed-tube (hereafter "air feed-tube" or simply "feed-tube").

Figure 2:
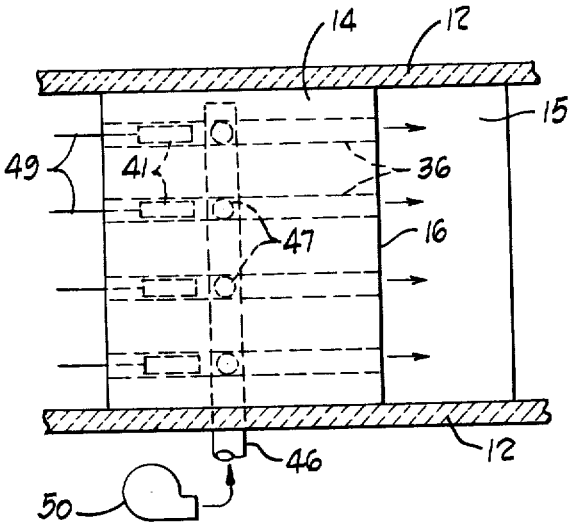
FIG. 2 is a plan view, partially in cross section, of a portion of the floor and side walls, diagrammatically illustrating plural air feed-tubes in one hearth, all tubes being of the same length, and each containing a reciprocable piston, shown in phantom outline in its retracted position.
Figure 3:
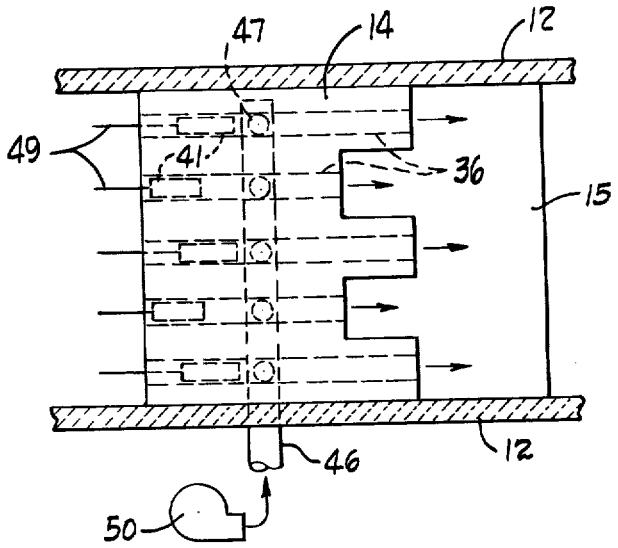
FIG. 3 is a plan view, partially in cross section, of a portion of the floor and side walls, diagrammatically illustrating plural air feed-tubes in another hearth, the tubes being of different lengths, and hence protected in a hearth of staggered configuration, each tube containing a reciprocable piston shown in phantom outline in its retracted position.

The upper portion 14 extends across the width of the stepped-hearth unit H' (as seen in FIGS. 2 and 3), and it extends longitudinally over preferably a major portion of the length L of H', through the precise length of the upper portion is not narrowly critical. The term 'longitudinal' refers to the direction of flow of waste through the incinerator, and 'width' refers to the horizontal direction at right angle to the longitudinal.

A ram means is provided, indicated generally by reference numeral 30, having a main ram body 31 which is reciprocable over upper portion 14, by reciprocating means 32 (shown for stepped-hearth units H'' and H'''), typically a fluid-actuated cylinder, and the ram means is supported by structural steel (not shown) in the steel shell of the incinerator. The particular category and construction of the reciprocating means is not critical, and it may be mechanical, electro-mechanical, pneumatic or hydraulic, most preferred being a hydraulic cylinder such as the one illustrated. The main ram body 31 is drivingly connected to the hydraulic cylinder 32 by its piston rod 33, the end of which is journalled on a pin 34 inserted in a clevis 35 welded or otherwise attached to the bottom of the main ram body near the end thereof, to provide the requisite length of stroke of the ram sufficient to push waste over the upper portion 14 and lower portion 15, and down portion 15, and down onto the next stepped hearth H''. The stroke of the ram will depend upon the length of each upper portion of each stepped-hearth unit, and may range from about 2 ft to about 8 ft.

It is not essential to have a ram advance the waste so that it tumbles down the steps if there is some other means for advancing the waste. As will be evident, my invention may also be used in an incinerator having an inclined plane hearth. In such an incinerator the inclined hearth is an unstepped relatively smooth planar refractory surface. Typically a load of waste to be incinerated is loaded into the combustion chamber near the top of the inclined hearth and the burning waste flows slowly downward as it continues to burn, propelled by gravity and the kinetic forces generated during combustion. In such an inclined hearth incinerator, plural clean-out assemblies may be used, disposed at predetermined intervals along the inclined hearth, and the connecting rods for each of the clean-out pistons may be drivingly connected to a common actuating means, or to separate actuating means, depending upon the periodicity desired for the manner in which the air feed-tubes are cleaned out.

However, of several means for advancing the waste, a ram means has been found to be particularly effective, which is a primary consideration for the stepped hearth incinerator. It is preferred to have a ram on at least half the number of hearths of a stepped hearth incinerator, and in the specific most preferred construction of my invention, a ram is provided on each stepped hearth.

Each ram is reciprocated at preselected intervals determined by the peculiar characteristics of the waste, the temperature of combustion attained in the combustion chamber, which temperature may be monitored with suitable thermocouples, and other considerations. The reciprocation of each ram may be programmed as may be the amount of air supplied for controlled combustion. Typically, reciprocation is effected at intervals ranging from about 2 min to about 30 min, the optimum interval being determined by routine trial and error, such as one skilled in the art would expect to undertake, and does.

Embedded within or disposed beneath the upper portion 14 of hearth H', and disposed in substantially horizontally spaced-apart relationship with each other are plural parallel air feed-tubes 42 having through-passages 36 generally coplanarly disposed above a plane defined by the top surface 15' of the lower portion 15. Each through-passage extends through the vertical portion 16. A clean-out means, indicated generally by reference numeral 40, for the through passage, provides a positive clean-out function, as will be explained in greater detail immediately hereinbelow.

The clean-out means 40 comprises a clean-out piston 41 slidably disposed for longitudinal reciprocation within the air feed-tube 42 which is open at one end, indicated by mouth 44, and closed by seal 48 at the other. The air feed-tube has gas-impermeable walls, and may be removably disposed, but is preferably cast in place within the upper portion 14 of the hearth H' so that the upper portion 14 overlies the air feed-tube protecting it from the deleterious effects attributable to the environment of the combustion chamber.

The air feed-tube 42 may be a tubular metal pipe but the cross-section is not critical and may be elliptical or rectangular. It is only essential that a clean-out piston 41 be slidably disposed in the air feed-tube which is stationary, and so held, so that at the end of the stroke, the leading surface 43 of the clean-out piston 41 travels past the mouth 44 of the air feed-tube. It is desirable to have the clean-out piston travel a substantial distance in the range from about 3 ins to about 2 ft past the mouth 44, sufficient to ensure that waste material being incinerated near the mouth 44 does not adhere and build up within or near the mouth to plug it. Travel of the clean-out piston 41 into the waste also forms an indentation, void or cavity in the waste, so that air from the air feed-tube can more easily permeate the waste to facilitate combustion. It is not desirable to have the stroke of the clean-out piston of such length that the trailing end of the skirt 45 of the piston clears the mouth 44 because the piston 41 is supported only by the air feed-tube and would fall out of it. This would preclude the piston's retraction into the air feed-tube.

Each air feed-tube 42 is manifolded in open communication with an air distribution manifold 46 extending transversely across and under the upper step 14 of each hearth, by an air feed-stub 47. Thus each feed-stub is in open communication at an angle, preferably a right angle as shown, relative to the longitudinal axis of the feed-tube.

The combustion air in the manifold is typically provided by a blower or compressor 50, at a predetermined pressure and rate, and the air may be diluted, if desired, with a diluent selected from the group consisting of moisture, steam, or a portion of the cooled effluent flue gases from the incinerator.

As indicated in FIG. 1, the clean-out piston 41 for hearth H' is fully extended forward, protruding from the mouth 44 of the feed-tube 42. During the forward stroke of the piston longitudinally towards the far end of the combustion chamber, the far end being that near which ashes are removed, flow of air through the feed-tube is blocked by the piston. The time during which such blockage of the air flow occurs is brief, being in the range from about 5 seconds to about 30 sec. As shown for hearth H", the fully retracted position of the piston 41 is anterior of the angle formed by feed-tube communicating with the feed-tube 47, and the piston rests at the near end of the feed-tube, the near end being that at which the combustion chamber is loaded.

To minimize leakage of air past the retracted piston 41, a seal 48 around connecting rod 49 is provided at the near end of the air feed-tube 42. As indicated, connecting rod 49 is drivingly connected to the main ram body 31 by journalling the end of the connecting rod on a pin 51 in a clevis 52. With this arrangement, the piston 41 is advanced through the air feed tube at the same time, that is, synchronously with the ram, every time the ram is actuated to push waste over the hearth.

The actuating first means for reciprocating the clean-out piston 41 may be independent of the ram, as may be the periodicity of the actuation of each. The function of the clean-out piston is quite different from and unrelated to that of the ram means. The clean-out provides a positive clean-out for the feed-tube and cavitates the burning waste to promote even and continuous combustion. The ram pushes burning waste from the surface of an upper hearth to a lower one, thus advancing and agitating the burning waste to promote better combustion.

It is not essential that the air feed-tubes be coplanarly disposed with the lower plane; the feed-tubes may be transversely disposed, that is at different elevations as they extend horizontally under the upper surface and substantially coextensive therewith to inject air into the waste. Further, as shown in FIG. 2, the upper portion 14 of a hearth in the stepped hearth floor may present, in plan view, an unbroken linear profile; or, as shown in FIG. 3, the upper portion 14, of another heart H" in the stepped hearth floor may present a staggered configuration or crenulated profile, alternate feed-tubes being of substantially unequal length.

In operation, a controlled amount of combustion air is supplied to the feed-tubes and solid waste is fed to the combustion chamber upon the loading hearth thereof, and ignited. Upon ignition of the waste, combustion is self-sustaining. As the solid waste burns, fresh solid waste is fed to the combustion chamber and the ram on the uppermost hearth pushes the burning waste onto a lower hearth.

As is illustrated in FIG. 1, when the ram is fully extended, the clean-out piston is synchronously advanced to the limit of its stroke which is sufficient to cavitate the waste but not so far as to allow the skirt of the piston to clear the mouth of the feed-tube. The protrusion of the piston into the solid waste not only provides a cavity adjacent the mouth of the feed-tube, but the stroke of the piston in the feed-tube cleans out debris within the tube and in the zone adjacent its mouth.

Upon retraction of the ram, the piston is also retracted to the near end of the feed-tube, that is anteriorly of the angle at which the feed-stub communicates with the feed-tube. The mouth of the feed-tube is now in open fluid communication with the manifold and the air issuing from the mouth of the feed-tube permeates the burning mass to facilitate combustion.

I claim:

1. In an incinerator having a combustion chamber for the controlled combustion of waste, the improvement comprising, (a) a floor of refractory material comprising plural descendingly stepped hearths, and, (b) clean-out means protectively shielded against deterioration due to the environment of said combustion chamber, said clean-out means comprising, (i) plural feed-tubes through which gas for supporting combustion of said waste is injected into it, said tubes being disposed longitudinally under the upper surface of a hearth substantially coextensively therewith, (ii) feed-stubs for conducting said gas to said feed-tubes, said feed-stubs communicating at an angle relative to said feed-tubes, and, (iii) a clean-out piston slidably reciprocably disposed in a feed-tube, said piston being drivingly connected to (iv) a first actuating means for reciprocating said piston at preselected intervals with a stroke having a length sufficient to advance said piston into said waste so as to clean out said feed-tube, remove debris plugging the mouth of said feed-tube, provide a void in the waste for distribution of air, and, to retract said piston in said feed-tube to a position anterior of said angle so as to permit flow of said gas to permeate said waste and facilitate combustion thereof.

2. The incinerator of claim 1 wherein said gas is predominantly air.

3. The incinerator of claim 2 wherein said gas includes at least one diluent selected from moisture, steam and a portion of cooled effluent gases from said incinerator.

4. The incinerator of claim 1 wherein said hearth includes an upper portion and a lower portion, the top surface of said upper portion being spaced apart from the top surface of said lower portion at a height in the range from about 2 to about 4 times the diameter of said feed-tube.

5. The incinerator of claim 4 wherein said feed-tubes are disposed in parallel spaced apart relationship with each other above a plane defined by said top surface of said lower portion.

6. The incinerator of claim 5 wherein said upper portion presents in plan view, a staggered configuration or a crenulated profile.

7. The incinerator of claim 5 wherein said feed-tubes are embedded within said upper portion.

8. The incinerator of claim 5 wherein said feed-tubes are disposed below said upper portion.

9. The incinerator of claim 4 including second actuating means to advance a main ram body along said top surface of said upper portion with a stroke substantially coextensive therewith so as to be sufficient to move combusting waste to said top surface of said lower portion and to the next hearth by reciprocating said main ram body longitudinally at preselected intervals.

10. The incinerator of claim 9 wherein the periodicity of reciprocation of said clean-out piston is independent of that of said main ram body.

11. The incinerator of claim 10 wherein said clean-out piston and said main ram body are reciprocated with the same periodicity.

12. In an incinerator having a combustion chamber for the controlled combustion of waste, the improvement comprising, (a) a floor of refractory material comprising plural descending stepped hearths, (b) ram means to reciprocate a main ram body above an upper hearth with a stroke substantially coextensive therewith so as to be sufficient to move combusting waste to a lower hearth, including actuating means drivingly engaged with said main ram body to reciprocate it longitudinally at preselected intervals, and, (c) clean-out means protectively shielded against deterioration due to the environment of said combustion chamber, said clean-out means comprising, (i) plural feed-tubes through which gas for supporting combustion of said waste is injected into it, said tubes being disposed longitudinally under the upper surface of a hearth and substantially coextensively therewith, (ii) feed-stubs for conducting said gas to said feed-tubes, said feed-stubs communicating at an angle relative to said feed-tubes, and, (iii) a clean-out piston slidably reciprocably disposed in a feed-tube, said piston being drivingly connected to said ram means so as to reciprocate said piston synchronously with said ram means with a stroke having a length sufficient to advance said piston into said waste so as to clean out said feed-tube and remove debris plugging the mouth of said feed-tube, to provide a void within the waste for distribution of air, and, to retract said piston in said feed-tube to a position anterior of said angle so as to permit flow of said gas to permeate said waste and facilitate combustion thereof.

13. The incinerator of claim 12 wherein said gas is predominantly air.

14. The incinerator of claim 13 wherein said gas includes at least one diluent selected from moisture, steam and a portion of the effluent gases from said incinerator.

15. The incinerator of claim 12 wherein said hearth includes an upper portion and a lower portion, the top surface of said upper portion being vertically spaced apart from the top surface of said lower portion at a height in the range from about 2 to about 4 times the diameter of said feed-tube.

16. The incinerator of claim 12 wherein said feed-tubes are disposed in parallel spaced apart relationship with each other above a plane defined by said top surface of said lower portion.

17. The incinerator of claim 16 wherein said feed-tubes are disposed below said upper portion.

18. The incinerator of claim 12 wherein said air feed-tubes are disposed in each of said stepped hearths.

* * * * *